United States Patent [19]

Eie

[11] 4,269,430

[45] May 26, 1981

[54] SKI BOOT HEEL ATTACHMENT

[76] Inventor: Nils Eie, Bamseveien 20, Oslo 3, Norway

[21] Appl. No.: 5,858

[22] Filed: Jan. 23, 1979

[30] Foreign Application Priority Data

Jan. 25, 1978 [NO] Norway ..... 780281

[51] Int. Cl.[3] ..... A63C 9/10

[52] U.S. Cl. ..... 280/614

[58] Field of Search ..... 280/614, 615

[56] References Cited

U.S. PATENT DOCUMENTS

| | | | |
|---|---|---|---|
| 3,003,777 | 10/1961 | Hilding | 280/614 |
| 3,388,918 | 6/1968 | Hollenback | 280/614 |
| 4,082,312 | 4/1978 | Johnson | 280/615 |

FOREIGN PATENT DOCUMENTS

| | | | |
|---|---|---|---|
| 54705 | 7/1950 | France | 280/614 |

*Primary Examiner*—Robert R. Song

*Attorney, Agent, or Firm*—Darby & Darby

[57] ABSTRACT

A device for attachment to skis and particularly cross country skis having a protrusion which fits into a cooperatively shaped recess in the ski boot heel to provide lateral boot heel stability when the heel is in contact with the ski surface and a locking means which engages a member which projects from the rear of the boot to prevent the boot from lifting off of the face of the ski.

18 Claims, 13 Drawing Figures

SKI BOOT HEEL ATTACHMENT

The invention relates to an arrangement for the releasable locking of a heel formed with one or more recesses on a leisure or cross-country skiing boot having locking members attached thereto.

In Alpine skiing a number of attaching arrangements are known for the releasable attachment of a ski boot to a ski. They co-operate with an independent attachment of the boot tip to the ski, or they can form part of a wire binding in which the heel is attached to the ski by the wire being latched into hooks or the like attached to on the sides of the skis under the heel.

In Scandinavian cross-country skiing also bindings of the last-mentioned class have been used which are known as Kandahar bindings.

However, these toe bindings which have been most widely used for cross-country skiing have, as a rule, not been combined with any member enabling the heel to be attached to the ski during downhill travel.

However, arrangements have been suggested for locking the heel to a cross-country ski which are combined with toe bindings. For instance, Norwegian Pat. No. 96.871 discloses how to lock a boot heel of the kind specified to a ski by means of a resilient hook which is attached to the rear of the ski and engages downwards into a bowed fitting on the boot heel. This method has a number of disadvantages. The resilient hook is relatively long and rather heavy and must be attached to the ski by means of a relatively large fitting. Moreover the ski must have a slot under the bowed member on the boot fitting in which the resilient hook can lie in normal travel, when the heel is not to be locked to the ski, as is the case in demanding downhill travel. A slot of this kind means both a further operation and a weakening of the ski, and this can be important in the case of narrow cross-country skis. This incision in the ski is necessary to enable the long bowed clamping member to rest below the heel bowed member without contacting the latter during normal travel.

Norwegian Patent Application No. 77.0581 also discloses a two-armed scales-like member which is attached to the ski and one end of which forms a hook which can engage in a fitting attached to the rear edge of the boot heel. The boot heel is locked to the ski by that engagement. In the neutral position—i.e., for ordinary walking movements—the hook rests on the scales-like member below the fitting in the rear edge of the boot, so that it cannot engage therewith, the result being the free movement usual with toe bindings. The scales-like member with the hook at one end is mounted via a through pin in a fitting attached to the boot. This construction can be subjected to relatively heavy stresses when loaded in the frontal direction, for instance, in falls in that direction. It may therefore be a problem to make the construction strong enough without it being at the same time too heavy, as is undesirable for use in cross-country skiing.

It is the object of the invention to solve the problems caused by the aforementioned constructions. According to the invention the problem is solved by the feature that the rear side of the boot heel has a projection or a projecting member attached therein. Attached to the ski are members which comprise members at least partially shaped to match the or each recess in the heel and a pivotable member having an arm for locking engagement with the projection on the rear side of the boot heel or the projecting member attached therein.

According to a preferred embodiment the projection on the boot heel extends forwardly at an inclination on the underside.

In another preferred embodiment a member attached to the rear side of the boot heel has a projecting surface extending substantially parallel with the surface of the ski.

Preferably the top side of the projecting surface is formed with a recess such that the pivotable member engaging therewith is retained therein.

In another preferred embodiment the projecting member takes the form of a bowed member.

Advantageously in such cases the bowed member has a curved bend in the middle in the vertical plane, which retains the engaging member supported in place.

Conveniently the pivotable member can be a butterfly nut screwthreadably attached to the ski. In that case one wing takes the form of a substantially orthogonal arm.

To give the butterfly nut satisfactory pivotability and at the same time treat the surface of the ski gently, a disc or washer can be disposed between the butterfly nut and the surface of the ski. The washer can be made of, for instance, plastic, Teflon or metal.

A resilient element can also be disposed between the attaching screw and the butterfly nut. When the bent arm of the butterfly nut engages with projections or other cooperating members on the heel member, the force produced by the tensioning of the spring will force the bent arm downwards to engagement with such co-operating members on the boot heel, thus helping the boot heel to be forced downwards towards the stabilizing elements attached to the ski. The resilient element can be for instance, a short spiral spring or a rubber disc.

The stabilizing member and butterfly nut can also advantageously be made unitary by a screw being screwed upwards from the base of the ski through such members. Advantageously the butterfly nut is disposed so close to the stabilizing element that pivotability is limited, and therefore the butterfly nut cannot drop off.

The pivotable member for fixing the boot to the ski can take the form of a bowed member having a pivoting axis lying in a plane extending longitudinally of the ski. Advantageously that part of the bowed memeber around which it pivots can lie substantially in that member attached to the ski which is shaped to match the or each recess in the boot heel.

Advantageously the end of this member and the immediate surrounding space are so shaped that during pivoting the bowed member latches into a locking and a non-locking position. Advantageously the pivotable arm is made of resilient material (for instance, steel) so that it can yield in such a way that the heel attachment is released during falls which might damage the ankles. This safety aspect has obvious advantages.

The pivotable member and the members with which it co-operates are advantageously made of metal, to give the required mechanical strength.

The members which are shaped to match the or each recess in the underside of the boot heel and which stabilize the boot on the ski during lateral twisting can be made of plastics or metal.

A number of embodiments of the invention will now be explained with reference to the accompanying drawings. However, the examples are not intended to limit the scope of the invention as expressed in the accompanying claims.

BRIEF DESCRIPTION OF THE DRAWINGS

FIG. 1 shows the rear portion 1 of a ski boot heel. The portion 1 is formed with recesses 2 and a projection 3 extending forwardly and downwardly at an inclination on the underside there between. The centre of the top side projection 3 is formed with a track 4.

FIG. 2 shows a stabilizing member having stabilizing elements 6 which are so shaped as to fill to a greater or lesser extent the recesses 2 in the rear portion 1 of the ski boot heel (FIG. 1). The stabilizing member 5 also has a tapped hole 7 for attachment to the ski.

FIG. 3 shows the elements illustrated in FIGS. 1 and 2 in locking engagement. The ski on which the boot heel stands and to which the stabilizing member is attached is not shown. The stabilizing elements 6 are so disposed in the recesses 2 that the boot is prevented from making lateral movements. The rear portion 1 of the boot heel is held down by bent arm 10 of a butterfly nut 9 having a further wing 11. Advantageously the bent arm 10 rests in track 4 (not shown in FIG. 3). The pivotable butterfly nut 9 is attached via a screw 12 to the ski (not shown). The rotation of the butterfly nut through 90° to the right or left releases the releasable locking of the rear portion of the boot heel to the ski. In this embodiment the stabilizing member 5 is attached to the ski by screws 8.

FIG. 4 illustrates a second embodiment of the invention. As in the first-described embodiment, the rear portion 1 of the boot heel is formed with recesses 2. Instead of the projection 3 shown in FIGS. 1–3, the rear portion 1 of the boot heel has a flat-headed pin 13. The head is flat in the longitudinal direction of the pin. The flat-headed pin 13 is so knocked into the rear portion 1 of the ski boot heel that only the head projects.

FIG. 5 shows the arrangement illustrated in FIG. 4 in locking engagement with a butterfly nut 9. The bent arm 10 of the butterfly nut 9 rests on the flat-headed pin 13. The butterfly nut 9 is in this instance also attached to a ski (not shown) via a screw 12. Disposed between the butterfly nut 9 and the ski (not shown) is a washer 14 which protects the ski against wear when the butterfly nut 9 rotates, and facilitates rotary movement. To simplify the drawing the necessary stabilizing member 5 is not shown. Operation is similar to that described in relation to FIG. 3.

FIGS. 6 and 7 are a side view and plan view respectively of a heel portion 1 of a ski boot. The bowed member 15 is substituted for the pin 13 shown in FIGS. 4 and 5. In this case only one recess in shown in the rear portion 2 of the boot heel.

FIG. 8 is a rear view of a boot heel rear portion having a recess 2 and a bowed member 15. In this embodiment the bowed member has a bend in the centre to enable the bent arm 10 on the butterfly nut 9 (not shown) to be retained in a stable manner.

FIG. 9 shows a heel portion having a projection 3 in locking engagement with the bent arm 10 on the butterfly nut 9 which is attached to the ski by screws 12. A short spiral spring 17 is disposed between the butterfly nut 9 and the screw 12.

FIG. 10 shows the stabilizing member 5 with the stabilizing element 6 and butterfly nut 9 combined into one unit by the screw 12 being screwed up from below through the stabilizing member 5, the washer 14 and the butterfly nut 9. The unit is screwed on to a ski (not shown) by screws (not shown). It is shown in locking engagement between the bent arm 10 and the projection 3 on the rear portion 1 of the boot heel. The stabilizing element 6 is disposed in the recess in the rear portion 1 of the boot heel.

FIG. 11 is a plan view of the unit illustrated in FIG. 10, the screws 8 for attachment to the ski being shown.

FIGS. 12 and 13 are a side view and rear view respectively of an embodiment in which the pivotable member takes the form of a bowed member 18. FIG. 12 shows the upper arm 10 of the bowed member in locking engagement with the projecting pin 13, while FIG. 13 shows it in the non-locking position. The arm 19 around which the bowed member pivots lies at the bottom of the stabilizing member 6. The end of the arm 19 is bent upwards and the space there around is so shaped that the bowed member latches into a locking and non-locking position respectively. The end of the arm 10 is bent in a loop to stabilize engagement with the pin 13.

Figure 1:
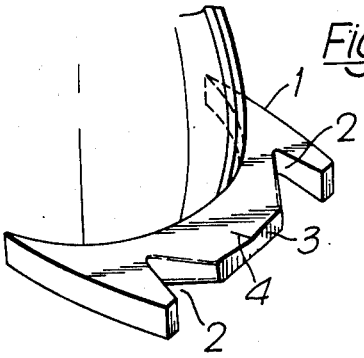
FIG. 1 is a perspective view of the rear portion of a ski boot showing boot heel recesses and protruding member.
Figure 2:
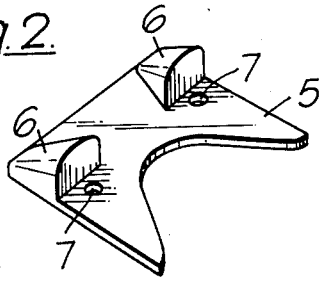
FIG. 2 is a perspective drawing of a heel plate with protrusions thereon for engagement with the recesses in FIG. 1.
Figure 3:
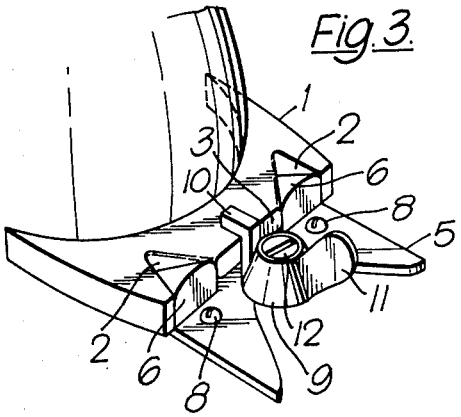
FIG. 3 is a perspective view of the rear portion of boot showing recesses in engagement with the protrusions of FIG. 2.
Figure 4:
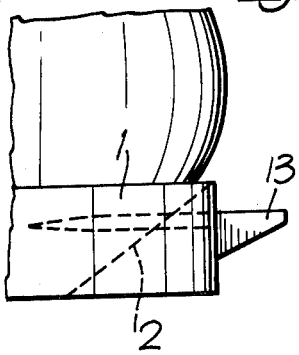
FIG. 4 is a side elevational view of a rear boot section pertaining to another embodiment of the invention.
Figure 5:
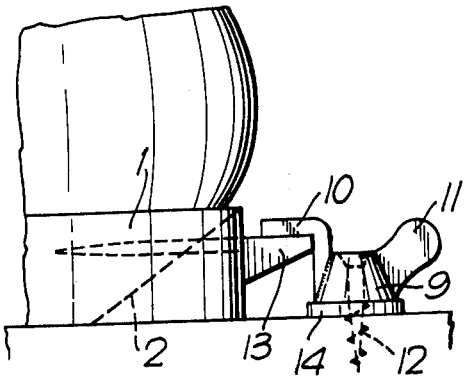
FIG. 5 shows the boot heel section of FIG. 4 with a locking means.
Figure 6:
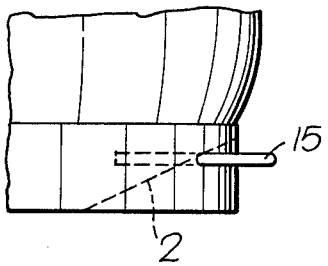
FIG. 6 is a side elevational view of a rear boot section according to another embodiment of the invention.
Figure 7:
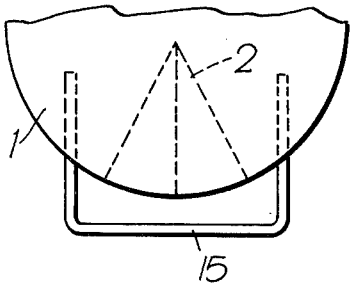
FIG. 7 is a plan view of the embodiment of FIG. 6.
Figure 8:
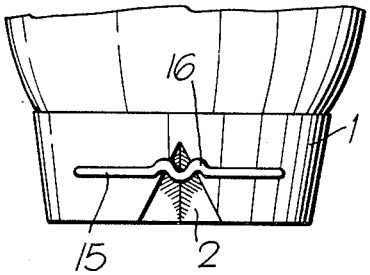
FIG. 8 is a rear elevational view of a boot section with another embodiment of the projecting member.
Figure 9:
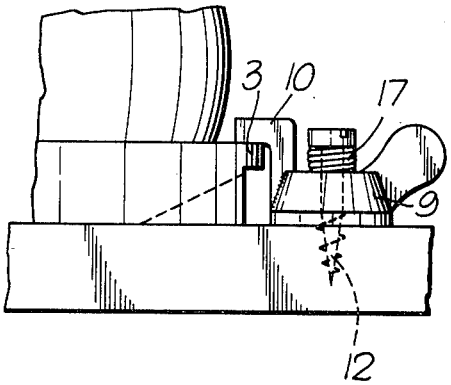
FIG. 9 shows a side elevational view of a rear boot section illustrating another embodiment of the locking means and protrusions.
Figure 10:
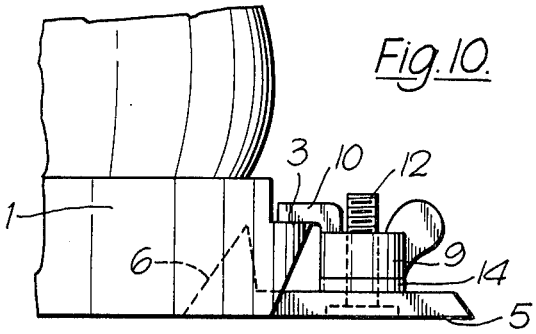
FIG. 10 shows a side elevational view of a boot heel section with protrusion and locking means engaging the heel.
Figure 11:
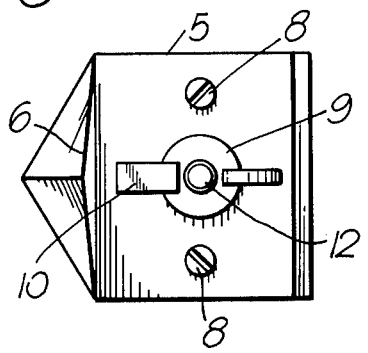
FIG. 11 shows a plan view of a locking means integrated with a protrusion 6.
Figure 12:
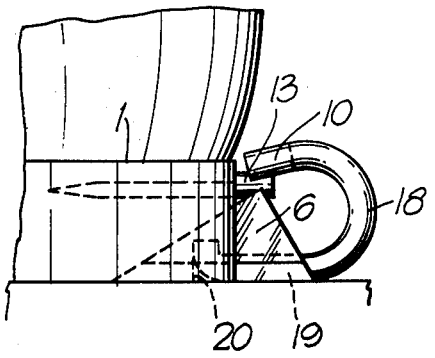
FIG. 12 shows a side elevational view of a boot heel section with another embodiment of the invention.
Figure 13:
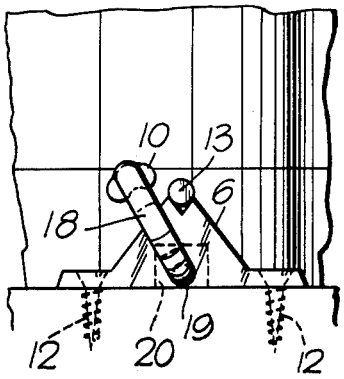
FIG. 13 is a rear elevational view of a boot section showing the embodiment of FIG. 12 in the unlocked position.

The inventive idea is set forth in the following claims.

I claim:

1. In combination with a ski boot of the type having a heel formed with at least one forwardly downwardly sloping recess which commences at the rear surface of the heel and terminates at an intermediate point between the rear surface and front surface of said heel:

a member attached to and projecting rearwardly from the rear surface of the boot heel, and locking means for attachment to the ski, said locking means including a forwardly downwardly sloping protrusion for matingly fitting into the recess of the ski boot heel and engaging the heel to provide lateral stability, and also including means for engaging the top of said rearwardly projecting member and locking therewith to prevent movement of the heel upwardly from the face of the ski.

2. The combination according to claim 1 wherein said locking means attached to the ski comprises a pivotable member having an arm for locking engagement with the projecting member on the rear side of the boot heel, the pivoting axis of the pivotable member being in a plane perpendicular to the ski and extending longitudinally thereof.

3. The combination according to claim 1 wherein the projection on the rear of the boot heel extends forwardly at an inclination on the underside.

4. The combination according to claim 1 wherein the projecting member of the rear of the boot heel has a projecting surface substantially parallel with the surface of the ski.

5. The combination according to claims 1 or 4 wherein the projecting surface on the top side of the projecting member is formed with a recess.

6. The combination according to claims 1 or 2 wherein the rearwardly projecting member comprises a separable piece insertable into the rear of the boot heel to a variable depth to control the upward release pressure of the boot by said engaging means of said locking means.

7. The combination according to claim 6 wherein the projecting member comprises a generally U-shaped piece extending from the rear of the boot heel.

8. The combination according to claim 7 wherein the U-shaped piece is formed with a curved bend in the center in the vertical direction for interlocking engagement of said engaging means.

9. The combination according to claims 1 or 2 wherein the pivotable member comprises a butterfly nut, screwthreadably attached to the ski, one wing of which is shaped as a bent arm.

10. The combination according to claim 9 further comprising a disc disposed between the butterfly nut and the surface of the ski.

11. The combination according to claim 2 wherein the pivotable member comprises a bowed member whose pivoting axis extends horizontally in the longitudinal direction of the ski.

12. The combination according to claim 1 wherein the means for engaging and locking with the projecting member of the ski boot heel comprises a pivotable member whose pivoting axis is generally parallel to the ski.

13. The combination of claim 12 wherein said pivotable member comprises a generally U-shaped piece, with one leg of the U attached to said locking means and pivotable therearound and the other leg for engaging the projecting member of the ski boot heel.

14. The combination of claims 12 or 13 wherein said locking means is shaped to receive the projecting member of said ski boot heel.

15. The combination according to claim 1, wherein the central portion of said rearwardly projecting member is adapted for cooperative engagement with said engaging means.

16. The combination according to claim 1, wherein the recess in the heel of the boot is wedge-shaped and is upwardly inclined from the intermediate point of the heel to its rear surface, and said protrusion is wedge-shaped and upwardly inclined from front to rear, being designed for cooperative engagement with said recess.

17. The combination according to claim 16, wherein the base of said protrusion widens from front to rear.

18. The combination according to claim 1, wherein the protrusion and engaging means of said locking means are combined in an integral unit.

* * * * *